US005228833A

United States Patent [19]

Schönenberger et al.

[11] Patent Number: 5,228,833

[45] Date of Patent: Jul. 20, 1993

[54] TURBOMACHINE BLADE/VANE FOR SUBSONIC CONDITIONS

[75] Inventors: Martin Schönenberger; Ulrich Steiger, both of Zürich; Said Havakechian, Baden; Nils Lannefors, Neuenhof, all of Switzerland

[73] Assignee: Asea Brown Boveri Ltd., Baden, Switzerland

[21] Appl. No.: 902,738

[22] Filed: Jun. 23, 1992

[30] Foreign Application Priority Data

Jun. 28, 1991 [CH] Switzerland ..... 1924/91

[51] Int. Cl.[5] ..... F01D 5/12

[52] U.S. Cl. ..... 415/181; 415/191; 415/208.1; 415/914

[58] Field of Search ..... 415/181, 191, 208.1, 415/914

[56] References Cited

U.S. PATENT DOCUMENTS

| | | | |
|---|---|---|---|
| 1,748,892 | 2/1930 | Nagler . | |
| 2,830,753 | 4/1958 | Stalker | 415/181 |
| 2,935,246 | 5/1960 | Roy | 415/181 |
| 2,949,224 | 8/1960 | Pavlecka | 415/181 |
| 3,156,407 | 11/1964 | Bourguard | 415/181 |
| 3,333,817 | 8/1967 | Rohmberg | 415/181 |
| 4,465,433 | 8/1984 | Bischoff | 415/914 |

FOREIGN PATENT DOCUMENTS

| | | | |
|---|---|---|---|
| 249844 | 12/1911 | Fed. Rep. of Germany . | |
| 490501 | 8/1938 | United Kingdom | 415/191 |

*Primary Examiner*—John T. Kwon

*Attorney, Agent, or Firm*—Burns, Doane, Swecker & Mathis

[57] ABSTRACT

In a turbomachine blade/vane for subsonic conditions with a convex curvature profile contour in the region of the leading edge and over the major part of the suction surface (S) and with a concave curvature profile contour in the region of the pressure surface (D), the profile contour in the suction-surface trailing edge region is designed to be concave (K). The momentum loss thickness mainly responsible for the profile loss is reduced in this region.

3 Claims, 1 Drawing Sheet

TURBOMACHINE BLADE/VANE FOR SUBSONIC CONDITIONS

BACKGROUND OF THE INVENTION

1. Field of the Invention

The invention concerns a turbomachine blade/vane for subsonic conditions with a convex curvature profile contour in the region of the leading edge and over the major part of the suction surface and with a concave curvature profile contour in the region of the pressure surface, the whole of the profile contour exhibiting a continuous curve.

2. Discussion of Background

In the design of the profile of such turbomachine blades/vanes, attention is generally paid to ensuring that the velocity maximum on the suction surface, and the subsequent deceleration which involves losses, are kept as small as possible. The profile contour in the known blades/vanes is generally designed to be either straight or slightly convex in the region of the suction-surface trailing edge. Other known possibilities for reducing the profile loss consist in delaying the laminar/-turbulent transition of the suction-surface boundary layer as far as possible by means of appropriate acceleration of the flow. This is based on the fact that a turbulent boundary layer is associated with greater losses than a laminar boundary layer.

SUMMARY OF THE INVENTION

Starting from the fact that the profile loss is mainly influenced by the momentum loss thickness present on the trailing edge of a blade/vane, one object of the invention is, in a turbomachine blade/vane of the type mentioned at the beginning, to take measures to keep the momentum loss thickness at the trailing edge as small as possible.

In accordance with the invention, this is achieved by designing a concave profile contour in the suction-surface trailing edge region. It is possible to influence the development of the boundary layer on the suction surface in a favorable way by means of this measure.

It is particularly useful for the concave section to extend from the trailing edge over a length substantially equal to the distance between two adjacent blades/-vanes at the narrowest cross section (throat).

Although it is already known art to design a concave suction-surface outlet region in transonic and supersonic blade/vane profiles, Laval conditions occur there in the functional interaction with the correspondingly configured pressure-surface outlet region of the neighboring blade/vane.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of an embodiment example of the invention using axial-flow turbine blading, wherein.

THE PREFERRED EMBODIMENTS

Figure 1:
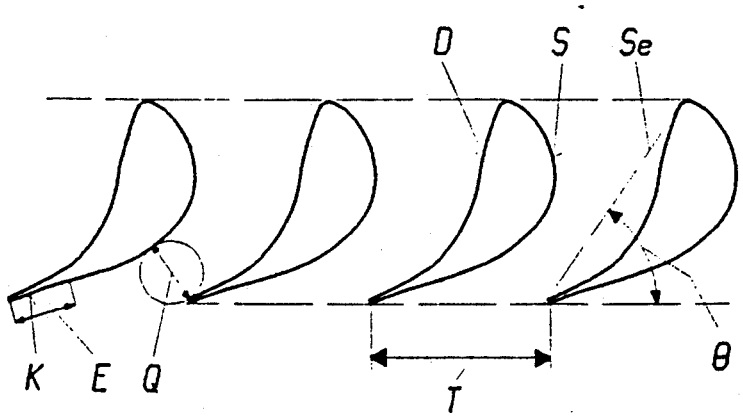
FIG. 1 shows a partial development of a cylindrical section through blading.

Referring now to the drawings, wherein like reference symbols designate identical or corresponding parts throughout the several views, in FIG. 1 the cylindrical development can be considered as a straight cascade of blades/vanes. It may be seen that this figure concerns turbine blading for subsonic conditions with the whole of the profile contour exhibiting a continuous curve. The chord of the blades/vanes is indicated by Se, S indicating the suction surface and D indicating the pressure surface. In the example shown, the ratio of the blading pitch T to the chord length Se is approximately 0.8. The blades/vanes are staggered at an angle $\theta$ of approximately 55°. The leading edge region and the major part of the suction surface are provided with a convex curvature profile contour. The pressure-surface region has a concave curvature profile contour. The narrowest cross section Q (throat) through which the working medium has to flow is, under these circumstances, the dimension between the pressure-surface trailing edge of a blade/vane and the convex back of the adjacent blade/vane, whatever the design of the suction-surface trailing edge. The invention is introduced on this element.

In the outlet flow region, the profile contour on the suction surface of the blade/vane is designed to be concave. This concavity, explained in more detail in FIG. 2, preferably extends from the actual trailing edge for an extent E which is approximately equal to the dimension Q mentioned above.

Figure 2:
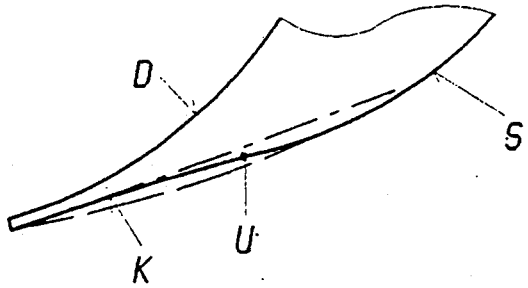
FIG. 2 is a representation comparing known and new trailing edge designs.

The new measure is presented in detail in FIG. 2. It is obvious that publication of all the absolute values based on the calculations should be omitted here because, in any event, these absolute values possess inadequate conclusive force since they depend on all too many parameters. For comparison purposes, the previously known profile contours are shown chain-dotted, the same trailing edge thickness being assumed in each case. The chain-dotted contour indicates a straight suction-surface trailing edge, the transition to the convex part not being shown; the dotted contour corresponds to the convex profile design which is a continuation of the convex back of the blade/vane. The new concave contour K is located between the two. As a non-binding dimensioning rule, the contour can be explained as follows. A tangent is laid from the trailing edge corner to the suction surface. The wall of the blade/vane now deviates from this tangent in the direction of the pressure surface. The new contour is therefore composed of two parts. Initially, there is a first section of increased convexity adjacent to the suction surface. This extends as far as the point of inflection U; the actual concave section K, which extends as far as the trailing edge corner, starts at this point. This profile contour must be shaped in such a way that after having reached its maximum, the suction-surface flow velocity is first decelerated with a steeper slope and subsequently with a more gentle slope. If appropriate, there may even be a slight acceleration to the trailing edge.

Figure 3:
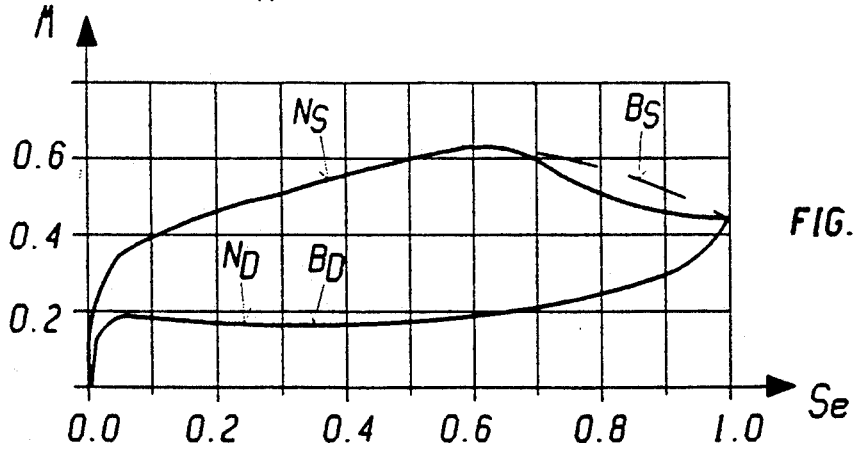
FIG. 3 shows a Mach number distribution diagram over the developed pressure-surface and suction-surface profile contours.
Figure 4:
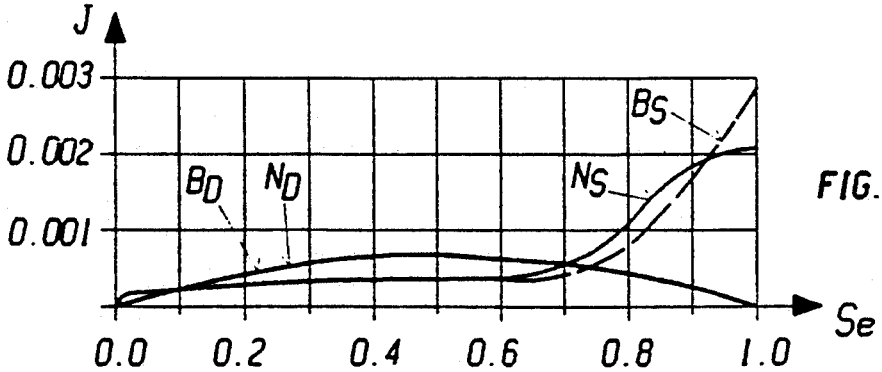
FIG. 4 shows a diagram of the momentum loss thickness distribution over the developed pressure-surface and suction-surface profile contours.

The qualitative and quantitative appearance of this is shown in the diagrams of FIGS. 3 and 4. The chord length Se of the blades/vanes is plotted non-dimensionally on the abscissae of the two diagrams. The Mach number M is plotted on the ordinate of FIG. 3 and the non-dimensional ratio J of the momentum loss thickness to the chord length is plotted on the ordinate of FIG. 4. The curves indicated by D indicate the conditions on the blade/vane pressure surface present in each case whereas the curves indicated by S represent the conditions present in each case on the blade/vane suction surface.

With respect to the profiles investigated, the solid curves N concern the profile provided with the new measure whereas the dotted curves B show the results for a profile with convex curvature of the suction-surface trailing edge. To make the matter more easily understood, let it be assumed that the same conditions are present in each case on the pressure surfaces of the two profiles investigated; the full curves $N_D$ are, in consequence, coincident with the dotted curves $B_D$ (not shown) in the two diagrams.

The curve $N_S$ of FIG. 3 shows the initial strong reduction in the Mach number towards the trailing edge with subsequent flattening off to the final value. In clear contrast to this is the shape of the curve $B_S$ which decreases continuously from the maximum value to the final value.

The effect of the new measure on the momentum loss thickness is presented in FIG. 4. The corresponding boundary layer calculations show that, by analogy with the Mach number distribution in FIG. 3, the larger slope of the decrease in velocity, in accordance with the curve $N_S$, initially leads to a stronger growth of the momentum loss thickness. The subsequent smaller slope of the decrease in velocity towards the trailing edge then leads to a marked flattening in the momentum loss thickness. Because of the new contour, the result is that the momentum loss thickness at the trailing edge, which is decisive for the profile loss, is smaller than the comparable value which can be achieved with a convex trailing edge, as is shown unambiguously by curve $B_S$.

Obviously, numerous modifications and variations of the present invention are possible in light of the above teachings. It is therefore to be understood that within the scope of the appended claims, the invention may be practiced otherwise than as specifically described herein. It can, for example, be applied with advantage to all turbine profiles with strong or slight deflection.

What is claimed as new and desired to be secured by Letters Patent of the United States is:

1. A turbomachine blade/vane for subsonic conditions with a convex curvature profile contour in the region of the leading edge and over the major part of the suction surface and with a concave curvature profile contour in the region of the pressure surface, the whole of the profile contour exhibiting a continuous curve, wherein the profile contour in the suction-surface trailing edge region is designed to be concave.

2. The turbomachine blade/vane as claimed in claim 1, wherein the concave section in the trailing edge region extends from the trailing edge a length between one and two times the distance of the throat between two adjacent blades/vanes arranged in a turbomachine.

3. A blade carrier for a turbomachine for subsonic conditions, comprising:

a blade carrier body;

a plurality of blades mounted on the body in a spaced, parallel relationship;

each blade mounted on the body so that adjacent blades form a flow region having a narrowest flow throat between a pressure surface trailing edge of a blade and a convex suction surface of an adjacent blade;

each blade having a continuous profile contour, a convex curvature in a region of a leading edge of the blade and over a major part of a suction surface of the blade, a concave curvature profile contour in a region of a pressure surface of the blade, and a concave profile surface in a trailing edge region of the suction surface, said trailing edge concave region extending from the trailing edge toward the leading edge a distance substantially equal to the distance between adjacent blades at the flow throat.

* * * * *